US005906444A

United States Patent [19]

Jorgensen

[11] Patent Number: 5,906,444

[45] Date of Patent: May 25, 1999

[54] BI-DIRECTIONAL THERMAL PRINTER AND METHOD THEREFOR

[75] Inventor: Arne Roy Jorgensen, Woodridge, Ill.

[73] Assignee: Illinois Tool Works Inc., Glenview, Ill.

[21] Appl. No.: 09/008,342

[22] Filed: Jan. 16, 1998

[51] Int. Cl.[6] ..... B41J 33/52

[52] U.S. Cl. ..... 400/229; 400/231; 400/323

[58] Field of Search ..... 400/229, 231, 400/233, 234, 323

[56] References Cited

U.S. PATENT DOCUMENTS

| | | | |
|---|---|---|---|
| 4,408,908 | 10/1983 | Applegate et al. | 400/229 |
| 4,420,268 | 12/1983 | Tsukamura et al. | 400/233 |
| 4,611,937 | 9/1986 | Sato et al. | 400/229 |
| 4,908,632 | 3/1990 | Ishikawa et al. | 400/120 |

FOREIGN PATENT DOCUMENTS

| | | | |
|---|---|---|---|
| 2175253 | 11/1986 | United Kingdom | 400/323 |

OTHER PUBLICATIONS

Dials et al., Ribbon Feed For Bidirectional Printer, IBM Technical Disclosure Bulletin, vol. 23, No. 4, pp. 1517–1520, Sep. 1980.

*Primary Examiner*—Edgar Burr
*Assistant Examiner*—Amanda B. Sandusky
*Attorney, Agent, or Firm*—John P. O'Brien

[57] ABSTRACT

A method and system for printing bi-directionally with a thermal print head movable back and forth along a print path adjacent a ribbon to transfer ink therefrom onto a substrate. The ribbon being drawn from an unwind reel and adjacent the print path, and the ribbon being clamped to maintain tension on the ribbon at least when the print head moves in the same direction as ribbon is drawn along the print path. A rotary drive member is rotatable in a first direction to actuate a brake member that clamps the ribbon against a fixed ribbon guide, and the rotary drive member is rotatable in a second opposing direction to rotate the rewind reel to draw ribbon from the unwind reel.

26 Claims, 3 Drawing Sheets

BI-DIRECTIONAL THERMAL PRINTER AND METHOD THEREFOR

CROSS REFERENCE TO RELATED APPLICATIONS

The present application is related to U.S. application Ser. No. 08/984,445 filed Dec. 3, 1997 entitled "Printer with Dancer Arm and Reel Brake and Method Therefor", and U.S. application Ser. No. 08/984,461, filed Dec. 3, 1997 entitled "Printer With Sealable Housing and Adjustable Back-up Plate and Method Therefor", both assigned commonly herewith, and incorporated by reference herein.

BACKGROUND OF THE INVENTION

The invention relates generally to product coding and marking operations, and more particularly to systems and methods for transferring print from a ribbon onto a substrate with a bi-directionally movable print head, and for advancing the ribbon and for braking advancement thereof with a bi-directional rotary drive member.

Thermal printing systems are employed widely for printing variable information on products and packaging in coding and marking operations. Many thermal printing systems include, for example, an inked ribbon or foil supplied from an unwind reel, between a thermal print head and a substrate, and then to a rewind reel. The ribbon is usually drawn intermittently under tension from the unwind reel by the rewind reel or by a ribbon feed roller, and the thermal print head is swept along a backside of the ribbon to transfer ink therefrom onto a target area of the substrate. More particularly, the thermal print head generally sweeps laterally, starting from a home position, along the backside of the ribbon in a direction opposite the ribbon feed direction so that the ribbon is held taut by the rewind reel or the feed roller during printing. After printing, the print head is sometimes moved away from the ribbon and is generally swept laterally back to the home position for the next print sweep.

In high production coding and marking operations, it is desirable generally to feed product or packaging to a print position opposite the print head as quickly as possible. In many such operations, however, the product or packaging can be fed to the print position more quickly than the print head can be moved back to the home position for the next print sweep. In these operations it is desirable to program the print head to print bi-directionally, thereby eliminating any delay associated with repositioning the print head. But when printing in the same direction as the ribbon feed direction, as will occur when printing bi-directionally, the ribbon has a tendency to form slack, which will prevent proper ink transfer, likely waste ribbon, and possibly jam the printer.

Also, many coding and marking printer systems are operated pneumatically, including, among other operational aspects, actuation of the thermal print head as disclosed in European Patent Publication No. EP 0,683,055 entitled "Economic Use of Impression Transfer Material Printing Method" published Nov. 22, 1995 in the name of Prestek Limited. Recently, however, there has been a trend in the manufacturing and packaging industries to eliminate from their facilities compressed air supply systems, which increases infrastructure, operational and maintenance costs. Also, usage of compressed air is very often a source of product contamination, particularly in the food processing and packaging industries. It is thus desirable to replace pneumatically operated coding and marking systems with all electrical systems, which are less costly and less problematic.

The present invention is drawn toward advancements in the art of transferring ink from a ribbon onto a substrate with a bi-directional thermal print head, and for advancing ribbon and braking advancement thereof with a bi-directional rotary drive member.

It is thus an object of the present invention to provide novel methods and systems for transferring print from a ribbon onto a substrate with a system that overcomes problems in the prior art.

It is a more particular object of the invention to provide novel methods and systems for printing bi-directionally with a thermal print head movable back and forth along a print path adjacent a ribbon to transfer ink therefrom onto a substrate. The ribbon being drawn from an unwind reel and adjacent the print path in the first direction of the print head, and the ribbon being clamped against a fixed ribbon guide to maintain tension on the ribbon at least when the print head moves in the same direction as ribbon is drawn along the print path. It is a related object of the invention to maintain tension on the ribbon with a rewind reel, which is rotatable in only one direction to draw ribbon from the unwind reel, when the print head moves in the second direction along the print path.

It is more particular related object of the invention to provide novel methods and systems for rotating a bi-directionally rotatable rotary drive member in a first direction to actuate a brake member that clamps the ribbon against a fixed ribbon guide, and rotating the rotary drive member in a second opposing direction to rotate the rewind reel to draw ribbon from the unwind reel.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
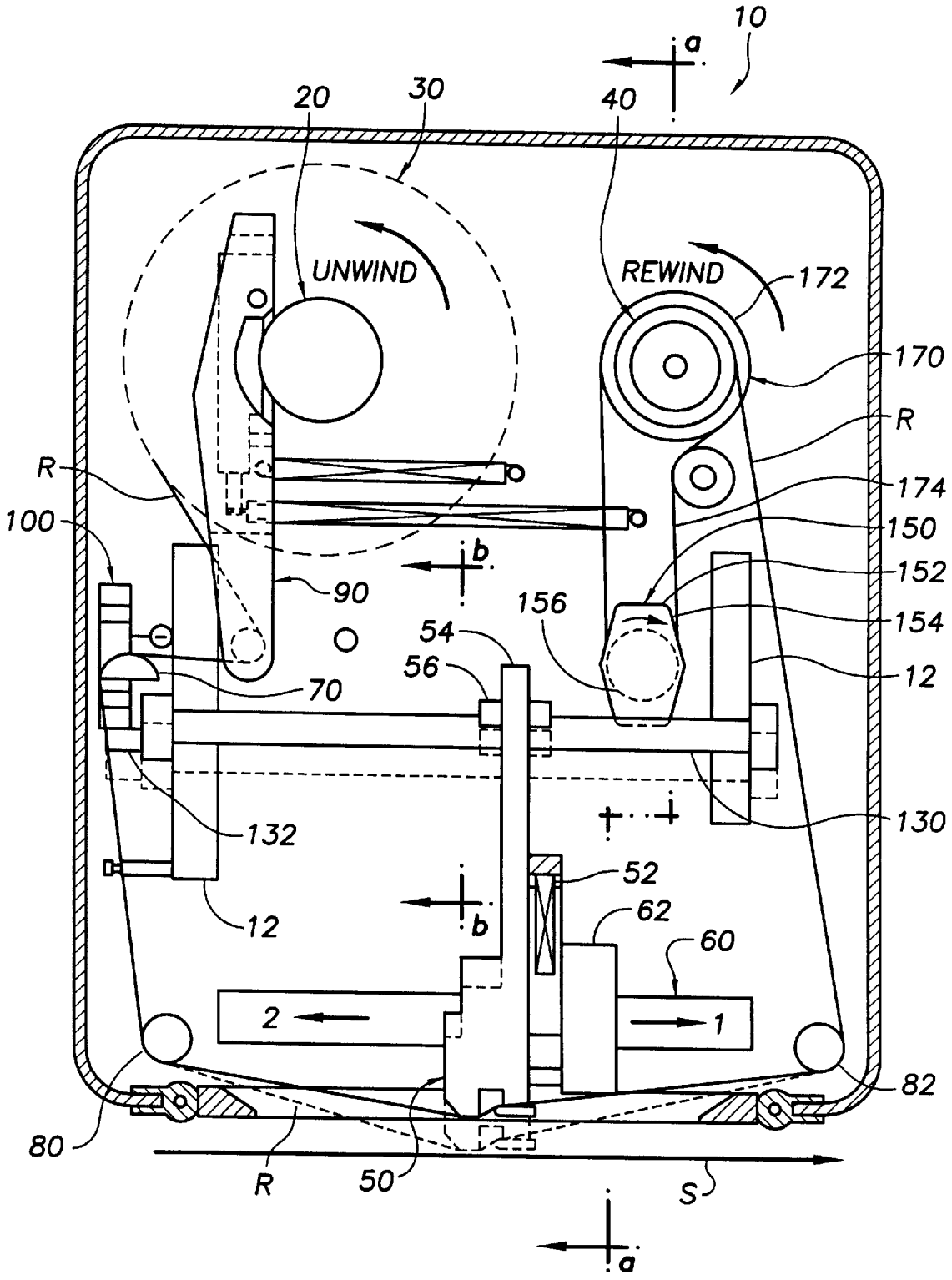
FIG. 1 is a partial front elevational view of a printer with a bi-directionally printing print head according to an exemplary embodiment of the invention.

FIG. 1 is an exemplary thermal printer system 10 incorporating aspects of the present invention, which is particularly suitable for product and package coding and marking operations. The printer system 10 includes generally an unwind reel 20 for supplying ribbon R from a ribbon supply roll 30, shown in phantom, disposed thereon. The ribbon R is supplied from the unwind reel 20 to a print position between a thermal print head 50 and a substrate S, where ink is transferred therefrom onto a target area of the substrate S. After printing, ink depleted ribbon is supplied toward and ultimately coiled about a rewind reel 40.

Figure 2:
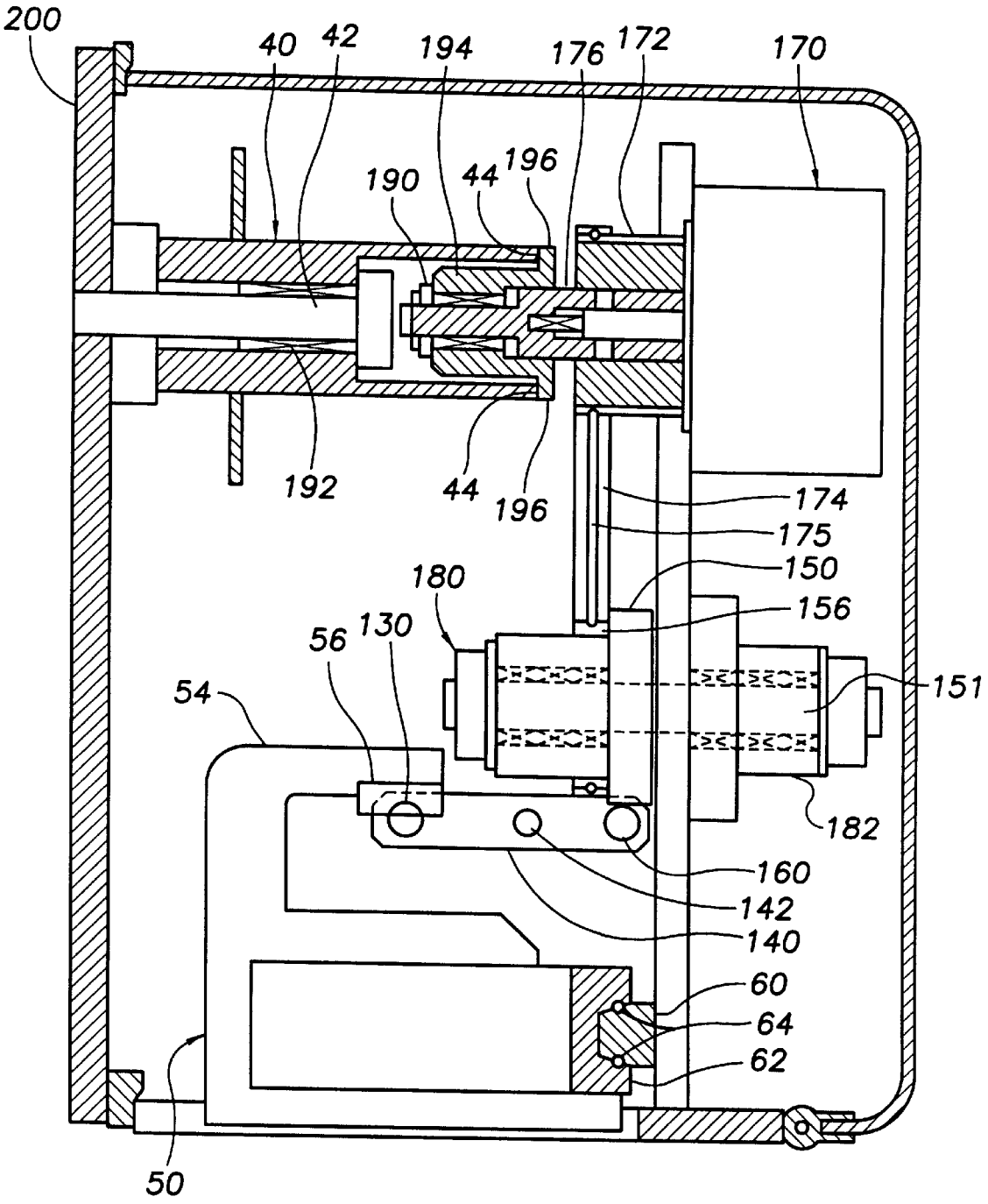
FIG. 2 is a partial side view along lines a—a of a ribbon brake assembly of FIG. 1 according to an exemplary embodiment of the invention.

FIGS. 1 and 2 illustrate the thermal print head 50 movable back and forth in first and second opposing directions, indicated by arrows 1 and 2, along a print path adjacent the ribbon R to transfer ink from the ribbon onto the substrate S. The print head 50 is more particularly slidably mounted on a rail 60 by a support block 62 with housing bearings 64, which facilitate movement of the print head 50 back and forth along the rail 60. The print head 50 is coupled to and driven by a reciprocating member, not shown, which is for example a belt member driven bi-directionally by rotatable pulleys disposed on opposing sides of the print head 50. According to a related alternative aspect of the invention, discussed further below, the print head 50 is also movable generally transversely toward and away from the substrate S.

Figure 3:
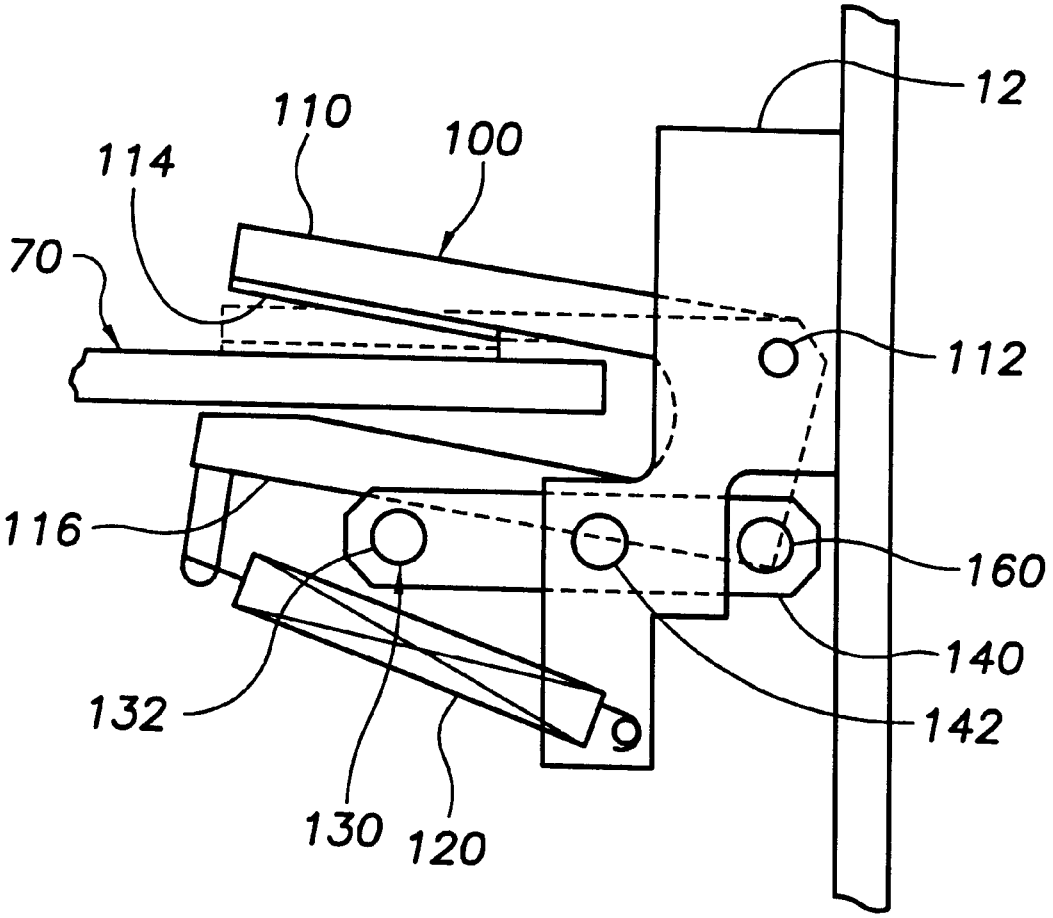
FIG. 3 is a partial side elevational view along lines b—b of the printer of FIG. 1.

FIGS. 1 and 3 illustrate a fixed ribbon guide 70 located between the unwind reel 20 and the print path, and more particularly the print head 50, wherein the ribbon R is supplied from the unwind reel 20 and drawn over the fixed ribbon guide 70 before it is drawn to the print position between a thermal print head 50 and a substrate S. FIG. 1 illustrates the ribbon R disposed over a dancer arm 90 disposed between the unwind reel 20 and the fixed ribbon guide 70. The dancer arm 90 is preferably of the type disclosed more fully in the copending U.S. application entitled "Printer with Dancer Arm and Reel Brake and Method Therefor" referenced above, although alternative embodiments may include more conventional dancer arms known in the art. FIG. 1 also illustrates the ribbon R disposed about guide rollers 80 and 82, which are disposed on opposing sides of the print head 50, thereby positioning the ribbon R along the print path thereof.

FIGS. 1 and 3 illustrate a ribbon brake member 100 actuatable to clamp the ribbon R against the fixed ribbon guide 70 to maintain tension on the ribbon R at least when the print head 50 prints in the first direction 1 along the print path, thereby preventing slackening of the ribbon R. The brake member 100 includes, more particularly, a brake arm 110 pivotal about a pivot member 112 and having an engagement member 114, which may be a resilient material like rubber to facilitate frictional engagement with the ribbon R. The brake member 110 is biased into engagement with the fixed ribbon guide 70, and in the exemplary embodiment is coupled to a brake spring member 120 interconnecting the brake member 100 and a frame portion of the printer system 10 for biasing the brake member 110 as discussed.

In one embodiment, the ribbon R is clamped at least when the print head 50 moves along the print path in the first direction 1. The rewind reel 40, which may alternatively be a feed roller that draws the ribbon R from the unwind reel 20, is rotatable in only one direction, thereby maintaining tension on the ribbon when the print head 50 moves along the print path in the second direction 2. In another embodiment, the ribbon R is clamped any time the print head 50 moves along the print path in either direction. According to this aspect of the invention, the print head 50 can print bi-directionally without slackening the ribbon R supplied from the unwind reel 20, thereby increasing productivity by eliminating any delays associated with repositioning the print head 50 to a home position before the next printing sweep.

FIGS. 1 and 2 illustrate a retraction rod 130 coupled to the print head 50, wherein the retraction rod 130 is movable between a first position and a second position to position the print head 50 toward and away from the substrate S, as shown phantomly in FIG. 1. Ink transfer from the ribbon R occurs when the print head 50 is biased toward the substrate S. FIG. 1 also illustrates the print head 50 including a printer spring member 52 biasing the print head 50 and the retraction rod 130 toward the substrate S. In the exemplary configuration, the printer spring member 52 is a compressed spring disposed between the print head 50 and a portion of the support block 62, thereby biasing the print head 50 toward the substrate S relative to the guide rail 60. The print head 50 includes a support arm 54 coupled to an upper portion of the retraction rod 130 by a bumper 56. Thus as the print head 50 is biased toward the substrate S, so too is the retraction rod 130, since the downwardly biased support arm 54 of the print head 50 is engaged with the retraction rod 130 along a topside thereof.

FIGS. 1 and 2 illustrate a pivoting arm 140 coupled to the retraction rod 130, and a rotatable cam 150 engageably coupled to the pivoting arm 140 to move the retraction rod 130 between the first position and the second position toward and away from the substrate S. In the exemplary configuration, the pivoting arm 140 is pivotal about a pivoting rod 142 coupled to the frame portion 12 of the printer system 10, and the rotatable cam 150 is coupled to the pivoting arm 140 by a cam engagement rod 160 coupled to the pivoting arm 140. The cam engagement rod 160 and the retraction rod 130 are on an opposing side of the pivoting rod 142 as shown. FIG. 2 illustrates the rotatable cam 150 engageable with the cam engagement rod 160 to alternately move the cam engagement rod 160 toward and away from the substrate S as the major and minor cam lobes 152 and 154 of the rotatable cam 150 alternately engage the cam engagement rod 160. Thus the cam engagement rod 160 actuates the retraction rod 130 to move print head 50 toward and away from the substrate S.

FIGS. 1 and 3 illustrate the retraction rod 130 engageable with the ribbon brake member 100 to pivot the brake arm 110 away from the fixed ribbon guide 70 when the print head 50 is positioned away from the substrate S, whereby the ribbon is clamped by the ribbon brake member 100 when the print head is positioned toward the substrate S. More particularly, in FIG. 3, an end portion 132 of the retraction rod 130 is engageable with a lower arm 116 of the brake member 100 to pivot the brake member 100 about the pivot member 112 against the bias of the brake spring member 120, thereby separating the brake arm 110 from the fixed guide member 70 and releasing the ribbon clamped therebetween.

According to the exemplary embodiment, when the print head 50 and the retraction rod 130 are positioned toward the substrate S, the brake spring member 120 biases the brake member 100 into engagement with the fixed ribbon guide 70 to clamp the ribbon R therebetween. The printer spring member 52 biases the print head 50 and the retraction rod 130 toward the substrate S when a minor lobe 154 of the rotatable cam 150 is engaged with, or at least directed toward, the cam engagement rod 160. Thus in the exemplary embodiment, the ribbon R is clamped by the brake member 100 any time the print head 50 is positioned toward the substrate S and when the print head 50 moves along the print path in both directions. As a major lobe 152 of the rotatable cam 150 engages the cam engagement rod 160, the cam engagement rod 160 is move toward the substrate S and the retraction rod 130 is moved away from the substrate S, resulting from the pivoting action of the pivoting arm 140 about the pivot shaft 142. The retraction rod 130 thus moves the print head 50 away from the substrate S and the end portion 132 thereof moves the brake member 100 away from the fixed guide member 70 to release, or unclamp, the ribbon R, thereby permitting drawing of ribbon R from the unwind reel 20.

FIGS. 1 and 2 illustrate a rotary drive member 170 rotatably coupled to the rotatable cam 150, whereby the rotary drive member 170 is rotatable in a first direction to move the retraction rod between the first position and the second position toward and away from the substrate S. More particularly, the rotary drive member 170 includes a rotatable drive hub 172 coupled to a cam hub 156 by a belt 174, which preferably has a reinforcement wire 175 protruding from an inner side thereof and disposed in corresponding grooves in the drive hub 172 and the cam hub 156 to align and guide the belt 174 thereabout. Thus as the rotary driver member 170 rotates in the first direction, the rotatable cam 150 rotates to actuate the cam engagement rod 160, thereby actuating the print head 50 and the brake member 100 as discussed above.

In the exemplary embodiment, the rotatable cam 150 is coupled to the cam hub 156 by a one-way cam hub clutch 180, for example a Torrington clutch, which permits rotation thereof in the clockwise direction only, corresponding to the first direction of the rotary drive member 170. The rotary drive member 170 is also rotatable in a second, counter-clockwise direction, discussed further below. When the rotary drive member 170 rotates in the second counter-clockwise direction, the one-way cam hub clutch 180 rotates freely relative to the rotatable cam 150, which is substantially fixed. In a preferred alternative embodiment, a one-way back-up cam hub clutch 182 is coupled to a shaft 151 of the rotatable cam 150 to prevent any tendency of the rotatable cam 150 to creep in the counter-clockwise direction as the one-way cam hub clutch 180 rotates freely.

FIGS. 1 and 2 illustrate the rotary drive member 170 rotatably coupled also to the rewind reel 40, whereby the rotary drive member 170 is rotatable in a second direction to rotate the rewind reel 40 in the counter-clockwise direction to draw ribbon from the unwind reel 20, which supplies ribbon as discussed above. More particularly, the rotary drive member 170 includes a rotatable shaft 176 coupled to the rewind reel 40 by a one-way reel clutch 190, for example a Torrington clutch, which permits rotation thereof in the counter-clockwise direction only, corresponding to the second direction of the rotary drive member 170. When the rotary drive member 170 rotates in the first clockwise direction, the one-way reel clutch 190 also rotates freely relative to the rewind reel 40, which is substantially fixed. In a preferred alternative embodiment, a one-way back-up reel clutch 192 is coupled to a shaft 42 of the rewind reel 40 to prevent any tendency of the rewind reel 40 to creep in the clockwise direction as the one-way reel clutch 190 rotates freely.

The rotary drive member 170 is preferably a bi-directional stepper motor, and according to the present invention is useable for rotating the rewind reel 40 to draw ribbon R from the unwind reel 20 and also for rotating the rotatable cam member 150 to position the print head 50 toward and away from the substrate S and to clamp the ribbon R. The bi-directional rotary drive member 170 thus eliminates the requirement of using compressed air to operate the print head, as in prior art printer systems, and reduces costs, heat generation within the printer system, and space usage associated with using separate dedicated motors.

In one embodiment, the rotatable shaft 176 is spring biased axially away from the rotary drive member 170, and a drive housing 194 of one-way reel clutch 190 mounted thereon includes a plurality of radially disposed pins 196 engageable with corresponding slots 44 formed on the end of the rewind reel 40. The slots 44 may be configured with a sloping side to facilitate engagement of the pins 196 therewith as the rotary drive member 170 rotates in the second, counter-clockwise direction. The rewind reel 40 is thus mountable on a cassette 200 to permit removable coupling of the rewind reel 40 with the drive housing 194 of the rotary drive member 170. In a preferred embodiment, the drive housing includes four pins 196 extending radially therefrom, and the rewind reel 40 includes two sets of four slots 44 offset approximately 45 degrees, thereby reducing the extent to which the rotary drive member 170 must rotate to engage the pins 196 in the slots 44 as required for driving the rewind reel 40.

While the foregoing written description of the invention enables one of ordinary skill in the art to make and use what is at present considered to be the best mode of the invention, it will be appreciated and understood by those of ordinary skill the existence of variations, combinations, modifications and equivalents within the spirit and scope of the specific exemplary embodiments disclosed herein. The present invention is therefore to be limited rot by the specific exemplary embodiments disclosed herein but by all embodiments within the scope of the appended claims.

What is claimed is:

1. A printer system for transferring print from a ribbon onto a substrate with a print head, the printer system comprising:

an unwind reel for supplying ribbon;

the print head movable back and forth in first and second opposing directions along a print path adjacent the ribbon to transfer ink from the ribbon, the print head movable toward and way from the substrate;

a fixed ribbon guide located between the unwind reel and the print path, the ribbon supplied from the unwind reel and over the fixed ribbon guide;

a ribbon brake member biased toward the fixed ribbon guide to clamp the ribbon against the fixed ribbon guide when the print head is positioned toward the substrate and the print head moves in the first direction.

2. The printer system of claim 1 further comprising a rewind reel rotatably coupled to a one-way reel clutch, the rewind reel is rotatable in only one direction, whereby the rewind reel maintains tension on the ribbon when the print head moves in the second direction along the print path.

3. The printer system of claim 1 further comprising a brake spring member coupled to a pivotal brake arm of the brake member to bias the brake arm into engagement with the fixed ribbon guide at least when the print head moves in the first direction along the print path, whereby the ribbon is clampable between the brake arm and the fixed ribbon guide.

4. The printer system of claim 1 further comprising a retraction rod coupled to the print head, the retraction rod movable between a first position and a second position to position the print head toward and away from the substrate, the retraction rod engageable with the ribbon brake member to move the ribbon brake member away from the fixed ribbon guide and unclamp the ribbon when the print head is positioned away from the substrate.

5. The printer system of claim 4 further comprising a printer spring member coupled to the print head and biasing the print head toward the substrate, whereby the ribbon is clamped by the brake member when the print head is positioned toward the substrate.

6. The printer system of claim 4 further comprising a pivoting arm coupled to the retraction rod, and a rotatable cam engageably coupled to the pivoting arm to move the retraction rod between the first position and the second position.

7. The printer system of claim 6 further comprising a cam engagement rod coupled to the pivoting arm, the rotatable cam engageable with the cam engagement rod to move the cam engagement rod toward and away from the substrate, whereby the retraction rod moves the print head away from the substrate and the brake member away from the fixed guide member when the cam engagement rod is moved toward the substrate.

8. The printer system of claim 6 further comprising a rotary drive member rotatably coupled to the rotatable cam, whereby the rotary drive member is rotatable in a first direction to move the retraction rod between the first position and the second position.

9. The printer system of claim 8 further comprising a rewind reel, the rotary drive member rotatably coupled to the rewind reel, whereby the rotary drive member is rotatable in a second direction to rotate the rewind reel to supply ribbon from the unwind reel.

10. The printer system of claim 9 further comprising a drive housing coupled to the rotary drive member, the drive housing having a plurality of radially disposed pins engageable with corresponding slots on the rewind reel.

11. A printer system for transferring print from a ribbon onto a substrate with a print head, the printer system comprising:

a rewind reel;

unwind reel for supplying ribbon to the rewind reel;

the print head movable back and forth in first and second opposing directions along a print path adjacent the ribbon;

a fixed ribbon guide located between the unwind reel and the print path, the ribbon supplied from the unwind reel and over the fixed ribbon guide;

a ribbon brake member biased toward the fixed ribbon guide to clamp their ribbon against the fixed ribbon guide when the print head moves in the first direction, a rotary drive member coupled to the print head and to the rewind reel, the rotary drive member rotatable in a first direction to move the print head toward and away from the substrate and the rotary drive member rotatable in a second direction to rotate the rewind reel to supply ribbon from the unwind reel, the ribbon clamped by the ribbon brake when the print head is positioned toward the substrate, and the ribbon unclamped when ribbon is supplied to the rewind reel.

12. The printer system of claim 11, the rewind reel rotatably coupled to a one-way reel clutch and rotatable in only one direction, whereby the rewind reel maintains tension on the ribbon when the print head moves in the second direction.

13. The printer system of claim 11 further comprising:

a rotatable cam rotatably coupled to the rotary drive member; and a retraction rod coupling the rotatable cam to the print head and to the ribbon brake member, the retraction rod movable between a first position and a second position by the rotatable cam to position the print head toward and away from the substrate and to clamp and unclamp the ribbon, whereby the rotatable cam rotates when the rotary drive member rotates in the first direction.

14. The printer system of claim 13 further comprising a pivoting arm coupling the retraction rod and the rotatable cam, whereby the retraction rod is movable toward and away from the substrate.

15. The printer system of claim 14 further comprising a cam engagement rod coupling the pivoting arm and the rotatable cam, the rotatable cam engageable with the cam engagement rod to move the cam engagement rod toward and away from the substrate, whereby the retraction rod moves the print head away from the substrate and the brake member away from the fixed guide member when the cam engagement rod is moved toward the substrate.

16. A method for transferring print from a ribbon onto a substrate with a bi-directional print head positionable toward and way from the substrate, the method comprising:

moving the print head back and forth in first and second opposing directions along a print path adjacent the ribbon when the print head is positioned toward the substrate, ink transferrable from the ribbon onto the substrate by the head when the print head moves in the first and second opposing directions;

supplying the ribbon over a fixed ribbon guide and adjacent the print path in the first direction of the print head;

clamping the ribbon against the fixed ribbon guide with a ribbon brake member when the print head is positioned toward the substrate and the print head moves in the first direction along the print path to prevent the supply of ribbon.

17. The method of claim 16 further comprising supplying ribbon from a unwind reel to a rewind reel and maintaining tension on the ribbon with the rewind reel when the print head moves in the second direction along the print path.

18. The method of claim 16 further comprising:

supplying the ribbon from an unwind reel and adjacent the print path in the first direction of the pint head, the ribbon supplied over the fixed ribbon guide located between the unwind reel and the print path;

positioning the print bead away from the substrate when supplying ribbon from the unwind reel; and unclamping the ribbon when supplying ribbon from the unwind reel.

19. The method of claim 18 further comprising biasing the print head toward the substrate, and biasing the I)rake member to clamp the ribbon when the print head is positioned toward the substrate.

20. The method of claim 18 further comprising moving a retraction rod between a first position and a second position with a rotatable cam to position the print head toward and away from the substrate and to clamp and unclamp the ribbon.

21. The method of claim 20 further comprising rotating the rotatable cam with a rotary drive member rotated in a first direction to move the retraction rod between the first position and the second position.

22. The method of claim 21 further comprising rotating a rewind reel with the rotary drive member rotated in a second direction to supply the ribbon from the unwind reel.

23. A method for transferring print from a ribbon onto a substrate with a print head, the printer system comprising:

supplying ribbon from an unwind reel to a rewind reel;

moving the print head back and forth in first and second opposing directions along a print path adjacent the ribbon to transfer ink from the ribbon;

supplying the ribbon from the unwind reel, adjacent the print path in the first direction of the print head;

supplying the ribbon over a fixed ribbon guide located between the unwind reel and the print path;

rotating a rotary drive member in a first direction to actuate a brake member that clamps the ribbon against the fixed ribbon guide, and rotating the rotary drive member in a second direction to rotate the rewind reel to supply the ribbon from the unwind reel when the ribbon is unclamped, whereby the ribbon is clamped by the brake member at least when the print head moves in the first direction along the print path.

24. The method of claim 23 further comprising maintaining tension on the ribbon with the rewind reel when the print head moves in the second direction.

25. The method of claim 23 moving the print head toward and away from the substrate when the rotary drive member rotates in the first direction, whereby the print head is positioned toward the substrate when the ribbon is clamped by the brake member.

26. The method of claim 25 further comprising rotating a rotatable cam when the rotary drive member rotates in the first direction, and moving a retraction rod between a first position and a second position with the rotatable cam, the retraction rod coupled to the print head and to the ribbon brake member, whereby the retraction rod positions the print head toward and away from the substrate and clamps and unclamps the ribbon when the rotary drive member rotates in the first direction.

* * * * *